United States Patent [19]

Miller

[11] Patent Number: 4,778,088

[45] Date of Patent: Oct. 18, 1988

[54] GARMENT CARRIER

[76] Inventor: Anne Miller, P.O. Box 61, Harrow, Ontario, Canada, N0R 1G0

[21] Appl. No.: 61,459

[22] Filed: Jun. 15, 1987

[51] Int. Cl.[4] ..... A47G 25/18; A47G 25/48

[52] U.S. Cl. ..... 223/91; 223/97; 211/113; 211/119; D6/315; D6/317; D6/328

[58] Field of Search ..... 223/85, 88, 97, 91, 223/DIG. 1; 211/113, 119; D6/315, 317, 328

[56] References Cited

U.S. PATENT DOCUMENTS

| | | | |
|---|---|---|---|
| D. 228,852 | 10/1973 | Vogelhuber et al. | D6/328 X |
| D. 250,242 | 11/1978 | Knobel et al. | D6/317 |
| D. 281,469 | 11/1985 | Honermann | D6/317 |
| 568,711 | 9/1896 | Bachrach | 211/113 |
| 828,491 | 8/1906 | Lokyitch | D6/317 X |
| 1,815,673 | 7/1931 | Kelley | 211/119 |
| 1,980,526 | 11/1934 | Herzog . | |
| 2,468,526 | 4/1949 | Tusay | D6/317 X |
| 4,136,784 | 1/1979 | Knobel et al. | D6/317 X |
| 4,709,838 | 12/1987 | Campbell | 223/DIG. 1 X |

FOREIGN PATENT DOCUMENTS

| | | | |
|---|---|---|---|
| 1022469 | 12/1952 | France | 211/119 |
| 487070 | 6/1938 | United Kingdom | 223/91 |

*Primary Examiner*—Robert R. Mackey

*Attorney, Agent, or Firm*—Gifford, Groh, VanOphem, Sheridan, Sprinkle and Dolgorukov

[57] ABSTRACT

A garment carrier which is particularly suited for holding scarves, mufflers, gloves and the like. The garment carrier of the present invention includes a hanger adapted to be hung on a conventional closet bar. At least one set of rings having a plurality of different size rings are secured to each other so that the rings increase in diameter from one end and to the other end of the set. The smallest ring is then attached to the hanger so that the set of rings depends downwardly from the hanger. Each ring forms an opening which is designed to receive a garment, such as a scarf, muffler or the like therethrough. In addition, preferably spring loaded clips are also secured to and depend downwardly from the hanger and are adapted to hold gloves, hats and the like.

1 Claim, 1 Drawing Sheet

GARMENT CARRIER

BACKGROUND OF THE INVENTION

I. Field of the Invention

The present invention relates generally to a garment carrier and, more particularly, to a garment carrier particularly suited for holding scarves, hats, mufflers, gloves and the like.

II. Description of the Prior Art

There are no previously known ways of efficiently storing scarves, hats, mufflers, gloves and the like in the closet so that the clothing article can be easily and rapidly identified and selected for wear. Instead, scarves, hats and the like are typically simply thrown in a pile on top of the closet shelf. This disadvantageously requires the person desiring a particular scarf or the like to search through the entire pile of clothes until the proper one is found. It also disadvantateously creates a messy and unorganized appearance for the closet. Furthermore, the scarves also become wrinkled when stored in this fashion.

SUMMARY OF THE PRESENT INVENTION

The present invention provides a garment carrier which overcomes all of the above mentioned disavantages of the previously known practices for storing clothing articles, such as scarves, gloves and the like.

In brief, the carrier of the present invention comprises a hanger having an upper hook adapted to be positioned over the closet bar and which supports an elongated and generally horizontally extending hanger section. At least one, and preferably two, sets of rings are then secured to the hanger section so that each ring set depends downwardly from the hanger.

Each ring set comprises a plurality of rings which are secured serially together. Furthermore, the rings increase in diameter from one end of the ring set and to the other end of the ring set. The smallest ring is then secured to the horizontally extending hanger section so that the entire ring set depends downwardly from the hanger.

Each ring forms an opening which is adapted to receive a garment, such as a scarf, muffler or the like therethrough. Thus, with the scarf, muffler or the like positioned through the ring opening, the ring supports the garment on the ring which in turn is supported by the hanger. The different size rings accommodate different sizes of garments.

In the preferred form of the invention, preferably a plurality of spring loaded clips are also secured to the hanger section so that they depend downwardly from the hanger and are spaced apart and parallel to each other. Each spring clip is adapted to hold a clothing article, such as a glove, hat or the like.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF THE PREFERRED EMBODIMENT OF THE PRESENT INVENTION

Figure 1:
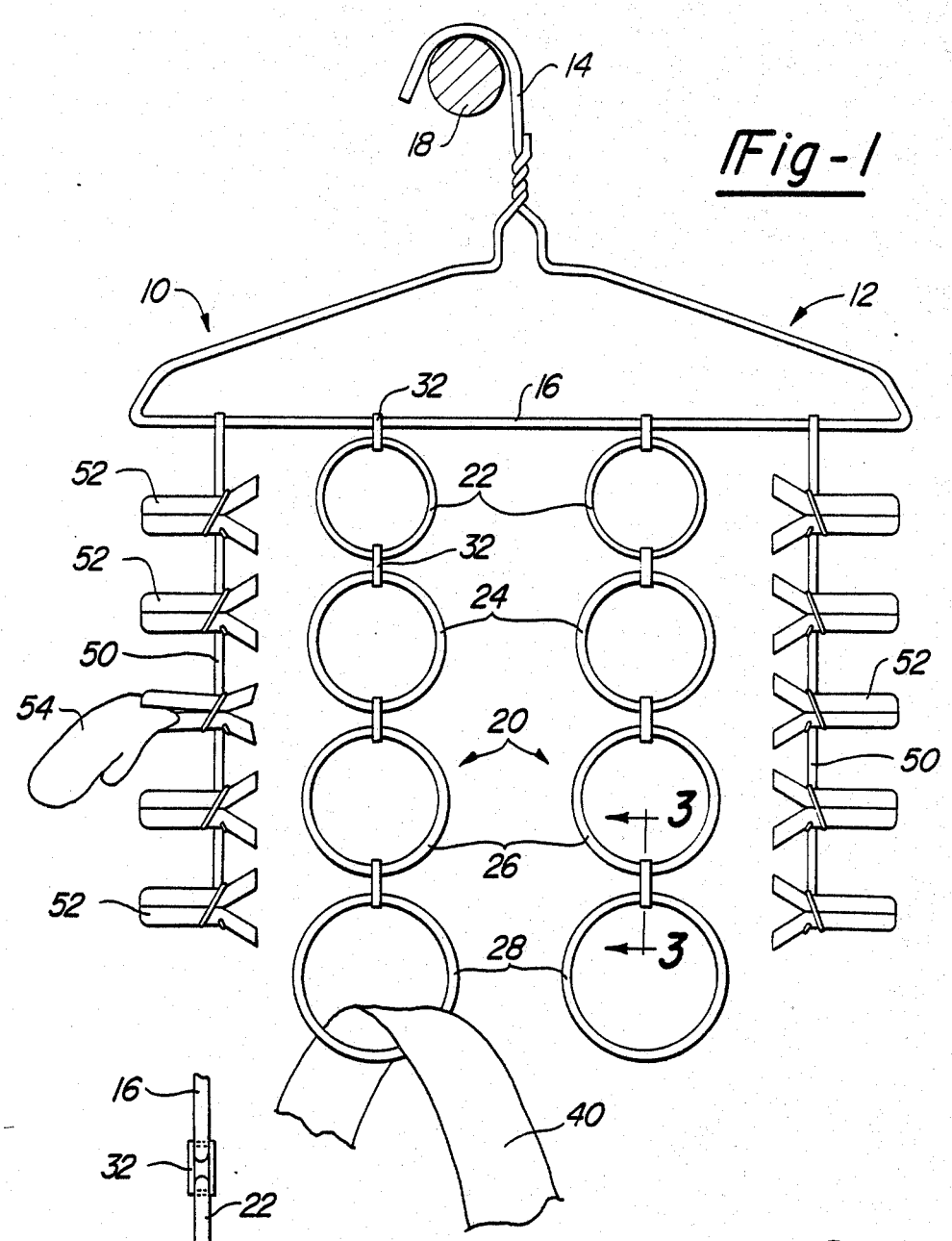
FIG. 1 is a front planar view illustrating a preferred embodiment of the present invention.

With reference first to FIG. 1, the preferred embodiment of the garment carrier 10 of the present invention is thereshown and comprises a hanger 12 having an upper hook 14 and an elongated and generally horizontally extending hanger section 16. The hanger hook 14 is adapted to be positioned over a closet bar 18 in the conventional fashion.

Still referring to FIG. 1, at least one and preferably two sets 20 of rings are secured to the hanger 12. Each ring set 20 is substantially identical to the other so that only one will be described in detail, it being understood that a like description shall also apply to the other set.

Figure 2:
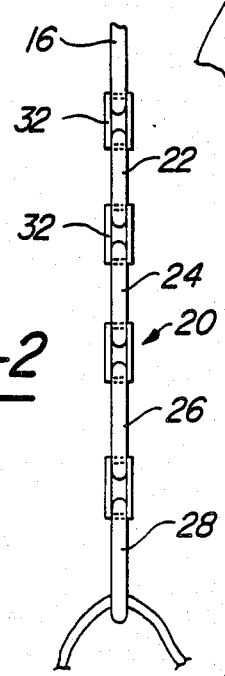
FIG. 2 is a side view illustrating the preferred embodiment of the present invention.

Referring now to FIGS. 1 and 2, the ring set 20 includes at least two rings 22 and 24 and, preferably, a plurality of rings 22–28. The rings increase in diameter from the ring 22 and to the ring 28 for a purpose to be subsequently described.

The first or smallest ring 22 is secured by a band 32 to the horizontally extending hanger section 16 so that the ring 22 depends downwardly from the hanger 12. The second ring 24 is then secured by another band 32 to the first ring 22 so that the ring 24 depends downwardly from the ring 22. Similarly, the ring 26 is secured by another band 32 so that it depends downwardly from the ring 24 and, likewise, the ring 28 is secured by a further band 32 (FIG. 3) to the ring 26 so that the ring 28 depends downwardly from the ring 26.

Preferably, the band 32 securing the ring 22 to the hanger section 16 is welded or otherwise secured against movement to the hanger section 16.

Figure 3:
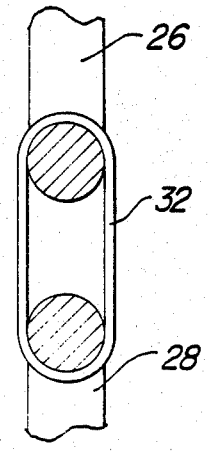
FIG. 3 is a fragmentary sectional view taken substantially along line 3—3 in FIG. 1 and enlarged for clarity.

With reference now to FIG. 3, although any conventional construction can be used for the band 32, preferably the band 32 comprises a loop which encloses a portion of the two adjacent rings 26 and 28.

With the ring set 20 depending downwardly from the hanger section 12, each ring 22–28 forms an opening which is adapted to receive a garment 40, such as a scarf, muffler or the like. The different size openings formed by the different size rings 22–24 thus accommodate garments having different thicknesses and different sizes.

With reference again to FIG. 1, in the preferred form of the invention at least one and preferably two elongated rods 50 are secured at one end to the hanger section 16 so that the rods 50 depend downwardly from the hanger 12. A plurality of spaced apart spring loaded clips 52 are then secured to the rods 50 in any conventional fashion so that the clips 52 are spaced apart from each other along each rod 50. These spring loaded clips 52 can then be used to secure garments 54, such as gloves, to the garment carrier 10.

From the foregoing, it can be seen that the carrier of the present invention provides a simple and yet totally effective means for storing and organizing clothing garments such as scarves, mufflers, hats, gloves and the like in one's closet. Furthermore, it has been found that scarves do not become wrinkled when held by the carrier of the present invention even when left in the carrier for prolonged periods of time.

Having described my invention, however, many modifications thereto will become apparent to those skilled in the art to which it pertains without deviation from the spirit of the invention as defined by the scope of the appended claims.

I claim:

1. A garment carrier comprising:

a hanger, a first set of rings and a second set of rings, wherein each set of rings comprises a first ring, a second ring and a third ring, said second ring having a greater diameter than said first ring and said third ring having a greater diameter than said second ring, each ring forming an opening adapted to receive a scarf therethrough, means for attaching said first and second rings together, means for attaching said second and third rings together, means for attaching said first rings to said hanger so that said second and third rings in each set depend sequentially downwardly from said first ring in each set, a pair of elongated rods, means for securing one end of each rod to the hanger, and a plurality of clips secured to each rod at spaced intervals therealong.

* * * * *